United States Patent [19]

Russell

[11] Patent Number: 4,893,454

[45] Date of Patent: Jan. 16, 1990

[54] ENVELOPE OPENING MACHINE AND METHOD

[75] Inventor: Robert J. Russell, Marlton, N.J.

[73] Assignee: Comtrex Systems Corporation, Moorestown, N.J.

[21] Appl. No.: 191,952

[22] Filed: May 6, 1988

[51] Int. Cl.[4] ..... B65B 43/30

[52] U.S. Cl. ..... 53/492; 53/381 R; 53/386

[58] Field of Search ..... 53/492, 381 R, 386, 53/387, 382, 50, 391, 390; 493/245

[56] References Cited

U.S. PATENT DOCUMENTS

| | | | |
|---|---|---|---|
| 3,691,726 | 9/1972 | Stephens et al. | 53/181 R |
| 3,979,884 | 9/1976 | Russell | 53/381 R |
| 4,295,321 | 10/1981 | DeHart et al. | 53/381 R |
| 4,333,300 | 6/1982 | Russell | 53/386 X |
| 4,388,793 | 6/1983 | Künne | 53/381 R |
| 4,527,378 | 7/1985 | Russell | 493/245 X |

*Primary Examiner*—James F. Coan
*Attorney, Agent, or Firm*—Charles F. Duffield

[57] ABSTRACT

A three sided envelope opening and extraction apparatus and method are disclosed. The envelopes pass from a supply hopper to three envelope slicing devices which open three sides of the envelope and thereafter, the envelopes are disposed into a transport system for conveyance to the opening apparatus with the unopened edge positioned generally downwardly. The opening apparatus includes opposed elongate folder blades which close upon the side panels of the envelope approximately one third of the distance above the unopened edge thereof to clamp the envelope therebetween. An opposed pair of elongate grasping members including suction cups engage the opposed panels of the envelope above the folder blades and pull the opposed panels downwardly and tautly against the folder blades to provide a deformed and permanent crease in the envelope panels along the folder blade edges whereupon the folder blades and grasping members release the envelope panels and are withdrawn away from the envelope panels. An envelope transport is provided to convey the envelopes in time sequence into the envelope opening apparatus and thereafter from the envelope opening apparatus, following the opening operation thereof, into an envelope receiving track at which point the contents thereof are extracted and sorted.

22 Claims, 12 Drawing Sheets

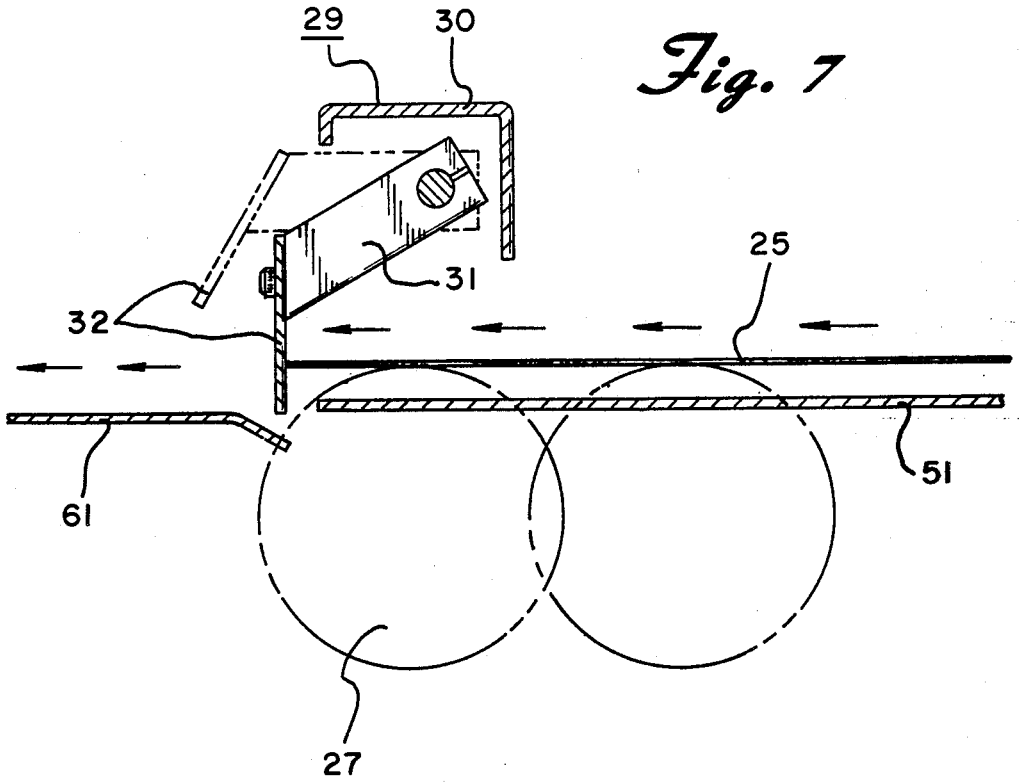
Fig. 7
Fig. 8
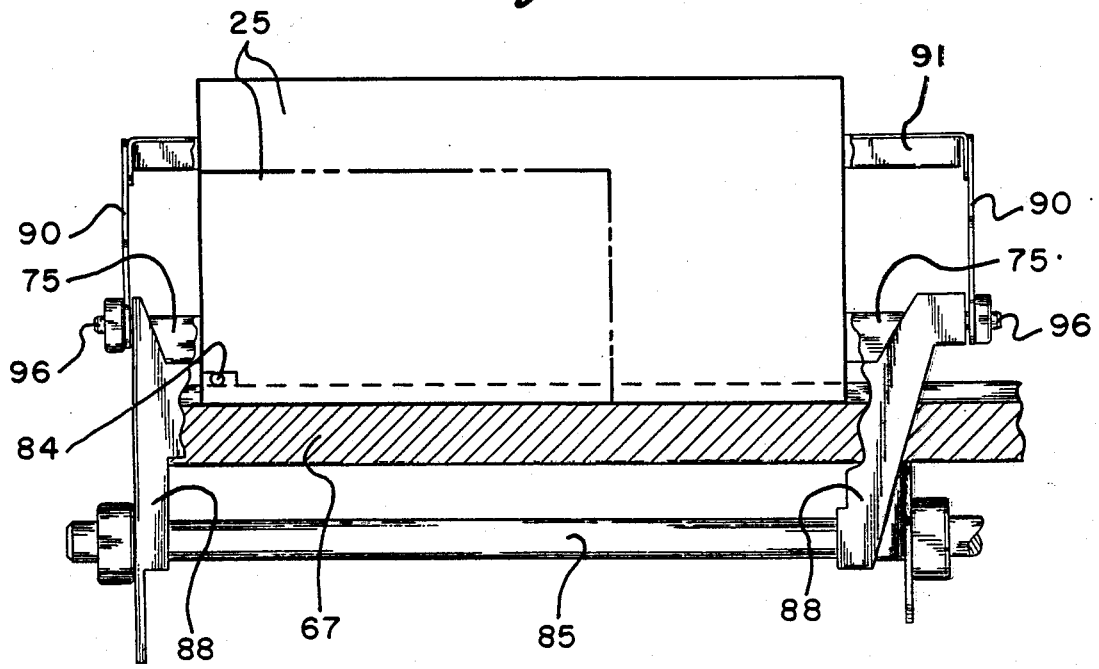

ENVELOPE OPENING MACHINE AND METHOD

BACKGROUND OF INVENTION

The present invention relates to apparatus and methods of their operation for opening envelopes and extracting the contents thereof and, more particularly, to an envelope opening apparatus and method of the single station or single operator type which opens the envelopes on three sides and presents their contents for extraction to a single operator.

Envelope opening machines can generally be categorized into two basic categories. The first category is the multi-station machine which is a very large, complex and expensive machine which opens envelopes and presents them to multiple stations at which personnel sit to sort the opened mail. The second category is the smaller, more compact and economic machine which utilizes a single operation station or, at best, two operator stations.

Within the second category of single operator stations, there are currently in commercial use a series of envelope opening machines which open the envelopes on one edge or two edges. Such machines are manufactured and sold by Opex Corporation of Cherry Hill, New Jersey and/or Mail-Ex Corporation of Connecticut. Examples of such machines are those as illustrated in U.S. Pat. Nos. 3,979,884 and 4,333,300.

Envelope opening machines such as the foregoing operate on the principle of first opening the envelopes, either on the single side or on two sides, at an opening station and then intermittently moving the envelopes in a stroking manner to an extraction station. At the extraction station, vacuum fingers utilizing suction cups are employed to engage the envelope panels and then pull them apart and pause during which time the operator then extracts the contents whereupon the vacuum cups then release the sides of the envelope and the envelope is then conveyed to a disposal station. Thereafter, the next envelope is brought to the extraction station in the stroking mode of operation.

Machines of the vacuum-stroking nature have distinct disadvantages. One significant disadvantage is that the extraction time is small. There is only one envelope presented to the operator at a time for extraction and the period of extraction is only that portion of the total cycle time during which the vacuum fingers engage and pull apart the envelope panels. A second significant disadvantage is that the vacuum fingers very often permit the vacuum to bleed through the panels of the envelope and attract or hold the contents of the envelope against one of the panels creating difficulty on behalf of the operator in extracting the contents.

Efforts have been made to eliminate the foregoing disadvantages of the vacuum-stroking machines. One such machine is that known as the Speed Track manufactured by Bell and Howell. Another is that known as the RX machine manufactured and sold by Mail-Ex Corporation of Connecticut.

The Bell and Howell machine pulls the side panels apart by vacuum fingers and then attempts to maintain the contents upright by means of directing the presumably upstanding contents into a set of guide rails as the envelope moves before the operator. However, again often the contents stick to the sides of the envelope or the envelopes are not entirely opened and a jam is occurred as the envelope approaches the rails. Additionally, in the Bell and Howell machine, the envelopes are brought to the extraction station in spaced sequence inasmuch as the opening mechanism is a stroking type of opening operation.

The Mail-Ex RX machine does not utilize vacuum but uses diverging adhesive belts. The envelopes are opened on three sides at a series of opening stations and thereafter the belts fed into the diverging adhesive belts in space relationship. Again, the envelopes therefore move in front of the operator in spaced relationship from one another and thus, create the disadvantage in that a longer extraction area is required to accommodate a given number of opened envelopes. Additionally in the RX machine, the adhesive often fails to secure the envelope panels properly and the envelopes tend to close back up again presenting extraction difficulty to the operator.

SUMMARY OF INVENTION

The envelope opening apparatus and method of the present invention is a single station machine but which provides envelope opening on three sides and further which operates in conjunction with vacuum but does not experience the disadvantages of the various single station vacuum operated machines heretofore described.

The envelope opener of the present invention utilizes a supply hopper from which envelopes pass through three slicing stations to open three edges of the envelope. After the envelope is passed through the slicing stations, the envelopes drop into an envelope transport system whereby they are transferred to the entrance of the envelope opening apparatus whereupon they are retained until cycling of the envelope opening apparatus.

The envelope opening apparatus includes a transport system which is designed to transport the envelopes selectively between two opposed and open elongate folder blades and an opposed pair of elongate envelope panel grasping members having suction cups thereon positioned above the folder blades. A photocell senses the proper positioning of the envelope within the opening apparatus and stops the transport means.

Upon de-energization of the transport means, the opposed elongate folder blades close upon the side panels of the envelope approximately one-third of the distance above the downwardly positioned unopened edge of the envelope to clamp the envelope and its included contents therebetween. Approximately simultaneously, the opposed pair of elongate grasping members and their included suction cups engage the opposed side panels of the envelope above the folder blades and, in accordance with the cycle of operation, retract backwards pulling the panels downwardly and tautly against the folder blades which remain closed to provide a deformed and permanent crease in the envelope panels along the folder blade edges. Thereafter in the cycle of events, the folder blades retract and the vacuum is released from the vacuum cups and the envelope opening apparatus returns to its rest or ready position for receipt of the next envelope.

Following the opening operation, the envelope panels are creased and thus, have assumed a permanent outward deflection along the datum line formed by the gripping of the folder blades. However, the elongate grasping members and their included suction cups move through a downward arc of approximately 120 degrees and this angle is so great that the contents, if they had any inclination to adhere to the side panels by reason of vacuum bleed through, cannot and spring backward into vertical position.

At the end of the opening cycle, the transport mechanism is again energized and the envelopes moved out of the opening mechanism into an open envelope track which is positioned slightly below a front work surface and fully exposed. The envelope track does not utilize a conveying means but, instead, the envelopes are moved along the track simply by the next exiting envelope from the opening mechanism engaging its predecessor and thus, envelope by envelope are moved along the envelope track in full view of the operator until the first proceeding envelope finally reaches a discharge point whereby it falls by gravity into a waste receptacle.

The envelope opening apparatus of the present invention thus overcomes the disadvantages of vacuum bleed through and retention of the contents. Additionally, inasmuch as the envelopes are moving in a steady end to end line in front of the operator, there is 100% extraction time and reduction of the total work desk due to the end to end relationship of the envelopes all thus overcoming the disadvantages of such machines as heretofore known.

DESCRIPTION OF DRAWINGS

FIG. 7 is a cross-sectional view of a typical envelope retaining gate of the present invention;

FIG. 8 is an end schematic view of a portion of the envelope opening apparatus of the present invention illustrating different sizes of envelopes;

DETAILED DESCRIPTION OF INVENTION

Figure 1:
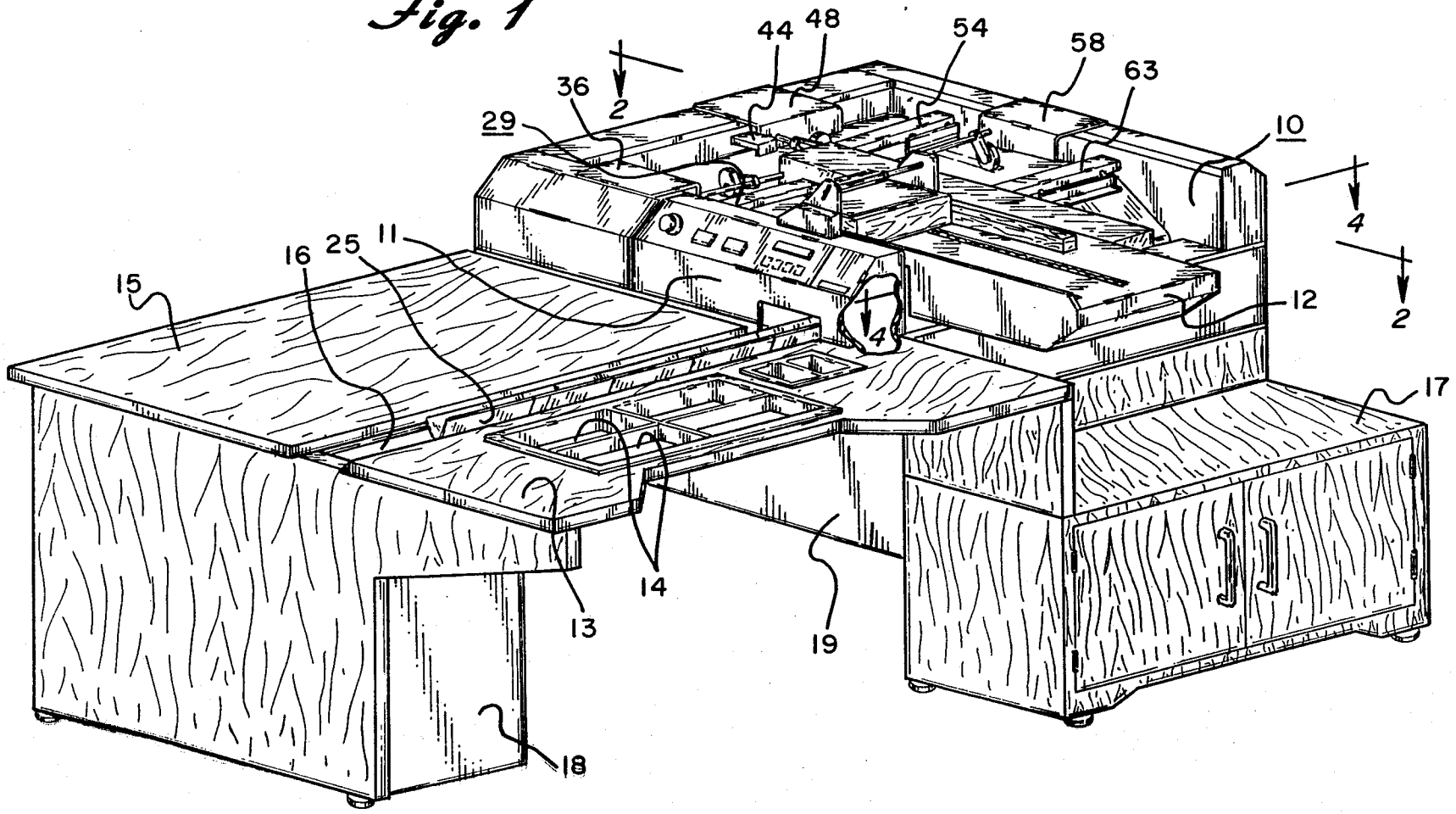
FIG. 1 is a perspective view of the overall configuration of the mail opening machine of the present invention.

The overall aspects of the mail opening machine of the present invention are shown in FIG. 1 of the drawings. The overall machine includes an envelope opening assembly 10. The envelope assembly 10 is suitably supported upon support legs (not shown) and houses the various opening apparatus such as a control panel 11, feed tray 12, the various envelope cutting stations and associated gates to be described hereinafter, the envelope transport system and envelope opening apparatus.

Associated with the overall envelope opening assembly 10 is a front work surface 13 with associated sorting trays 14. Opposite the front work surface 13 is a back shelf 15, all of which is appropriately supported on leg members. Disposed between the front work surface 13 and back shelf 15 is the track trough 16 and its associated envelope track as to be discussed hereinafter.

A storage cabinet 17 is positioned off of the right side of the work surface. The storage cabinet is for a matter of convenience.

Disposed beneath the back shelf 15 is an empty envelope receptacle 18. The envelopes, following extraction of their contents, move from the right to the left in the envelope track and fall through an opening at the end thereof into the empty envelope receptacle 18.

Positioned underneath the envelope opening assembly 10 is a second chip receptacle 19. The chip receptacle is large enough to be positioned under three different cutters, as to be explained hereinafter, to receive the chips cut from the edges of the envelopes as they pass between the cutters and fall through an open chute leading directly into the chip receptacle box 19.

Figure 2:
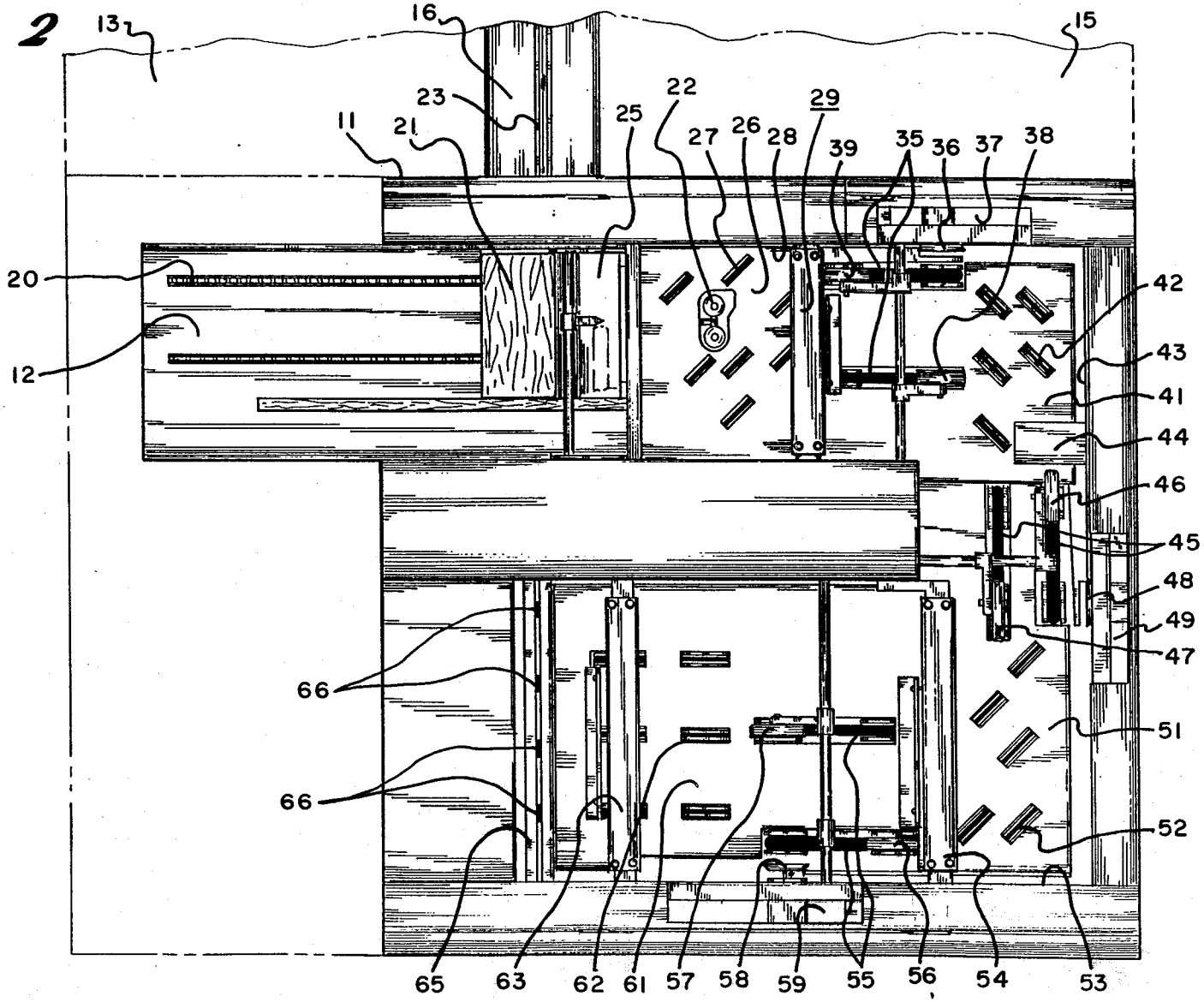
FIG. 2 is a top view of the envelope supply hopper and envelope edge cutting apparatus of the present invention.
Figure 3:
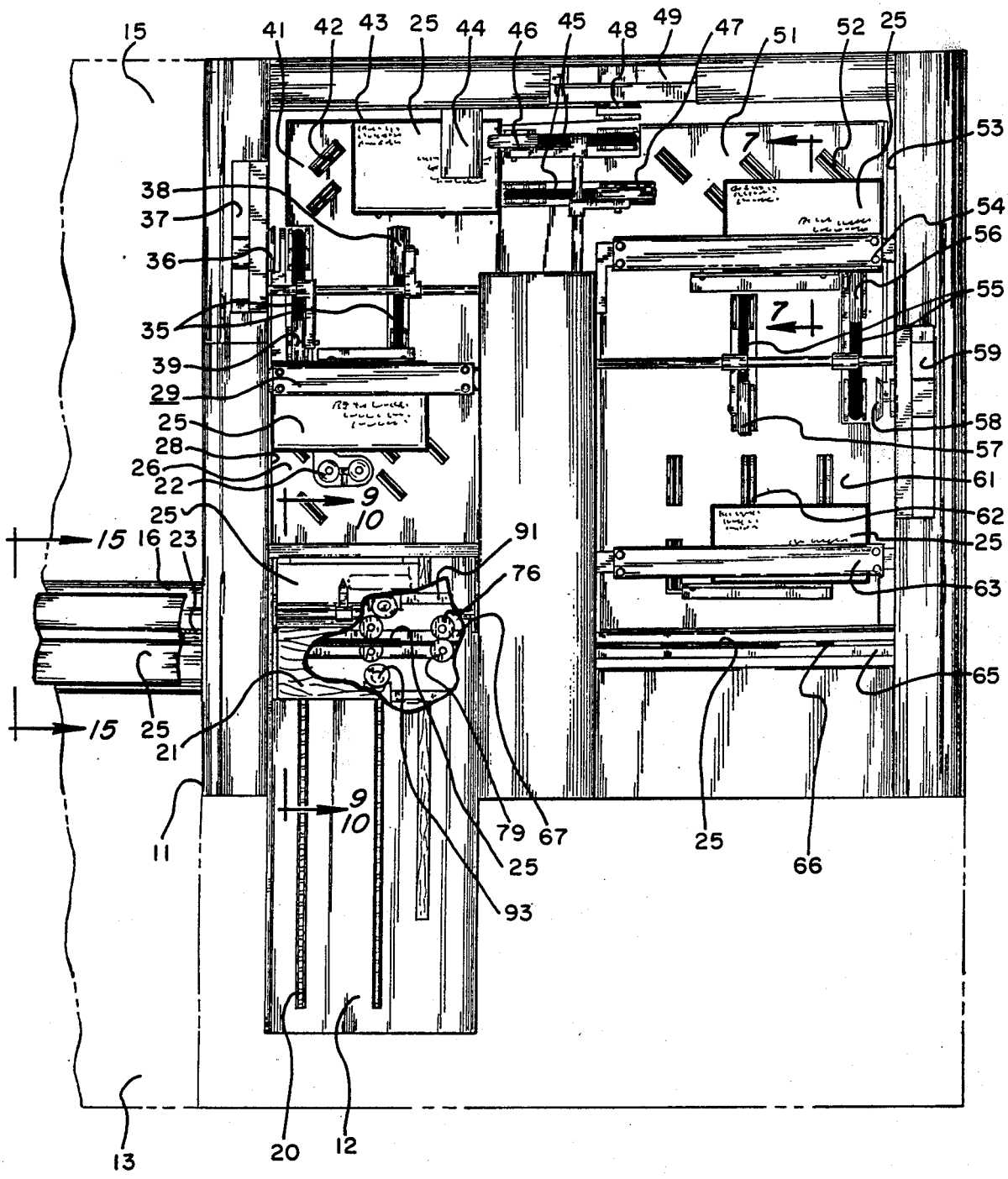
FIG. 3 is the identical view of FIG. 2 showing an envelope in position at the envelope retaining gates prior to envelope edge cutting.

Referring now to FIGS. 2 and 3, there is illustrated a top plan view of the upper portion of the envelope opening assembly 10. The feed tray 12 includes a set of conveyor chains 20 and associated follower block 21. This setup works in a fashion such that, as envelopes are placed in front of the follower block 21, the conveyor chains 20 will operate until the stack of envelopes reaches a photocell thereby stopping further actuation of the conveyor chain until sufficient envelopes have been removed to again actuate the conveyor chain to continuously be moving envelopes into position for extraction from the tray.

Extraction of the envelopes from the feed tray is accomplished by means of a vacuum pickup 22. The vacuum pickup rises up from beneath a wheelplate 26 to engage an envelope 25 and pull it downwardly upon the wheelplate 26. The wheelplate 26 includes a plurality of wheels 27 which are rotating and are positioned on an angle. The envelope engages the wheels 27 and is pulled into alignment against the side rail 28 of the machine and against a first gate mechanism 29. Such an arrangement is illustrated in FIG. 3 wherein the positioning of the envelopes at the respective gates is illustrated.

A typical envelope gate assembly 29 is illustrated in FIG. 7. The gate assembly includes a cover plate 30 which is secured to the wheelplate. Pivoted within the ends of the gate cover 30 is a gate arm 31 and its associated gate 32. FIG. 7 illustrates an envelope 25 riding upon the wheels 27 in abutment with the gate 32 during one phase of the envelope opening cycle.

Returning now to FIG. 2, downstream of the first wheelplate 26 is a conveyor belt assembly including two conveyor belts 35. These conveyor belts 35 are inclined at approximately a 3° angle toward the rail and direct the envelope into a first slicer assembly 36.

The first slicer assembly 36 includes two rotating slicing wheels. One of these slicing wheels is driven whereas the other is in overlapping relationship and is spring loaded. In operation as the edge of the envelope passes between the slicing wheels, a small portion thereof is sliced or trimmed off.

As illustrated in FIG. 2, the trimmed edge or chip, as it is known, of the envelope is free to fall into an open chute 37 which leads downwardly into the chip box or receptacle 19 as illustrated in FIG. 1. This open chute arrangement constitutes an advance in the art inasmuch as heretofore the chips were directed through various channels or tubular members to a chip receptacle and would often clog or jam causing a shutdown of the machine.

A pair of pressure rollers 38 and 39 are positioned over the conveyor belts 35. The pressure rollers press downwardly on the envelope as it passes along the conveyor belts to insure accurate and positive conveyance of the envelope through the cutting assembly.

As the envelopes pass through the first cutting assembly, they come upon a second wheelplate 41. The envelopes first encounter a second set of rollers or wheels 42 which convey the envelopes, in a like manner, against a second rail 43 and against a second gate assembly 44. The second gate assembly 44 is substantially of the same design as the first gate assembly.

The first wheelplate, associated rollers, gate assembly and first slicer assembly are designed to trim one small side of the envelope.

Positioned downstream from the second gate assembly 44 is a like set of conveyor belts 45 positioned on a 3° angle. Positioned above them is a like set of pressure rollers 46 and 47. A second slicer assembly 48 is positioned at the ends of the conveyor belts and cooperates with a chip chute 49 all in the same manner as that previously described for the first opening station. The second wheelplate and its associated rollers, gate assembly and associated conveyor belts and slicer are designed to open the long edge of the envelope.

Positioned downstream from the second wheelplate 41 is a third wheelplate 51. The second wheelplate 51, as in the case of the other wheelplates, includes a set of inclined roller wheels 52 which are designed to bring the envelope into engagement with the third rail 53 and against a third gate assembly 54, all as herebefore described.

Positioned again downstream from the third gate assembly 54 is again a set of conveyor belts 55 and associated pressure rollers 56 and 57. These elements cooperate with a third slicing assembly 58 and chip chute 59 as heretofore described. This arrangement is designed to open the opposite short side of the envelope constituting the opening of the third side of the envelope.

Downstream from the third cutting assembly is likewise a fourth wheelplate 61, associated conveyor wheels 62 which, in this case, direct the envelopes in a straightforward direction to a fourth envelope gate 63.

Downstream from the fourth gate 63 is a V-shaped vertical drop chute 65. Positioned beneath the vertical drop chute 65, and as best seen in FIGS. 4 and 5 of the drawings, are a plurality of drop rollers 66 which form a part of the overall envelope transport system to be hereinafter described.

Figure 4:
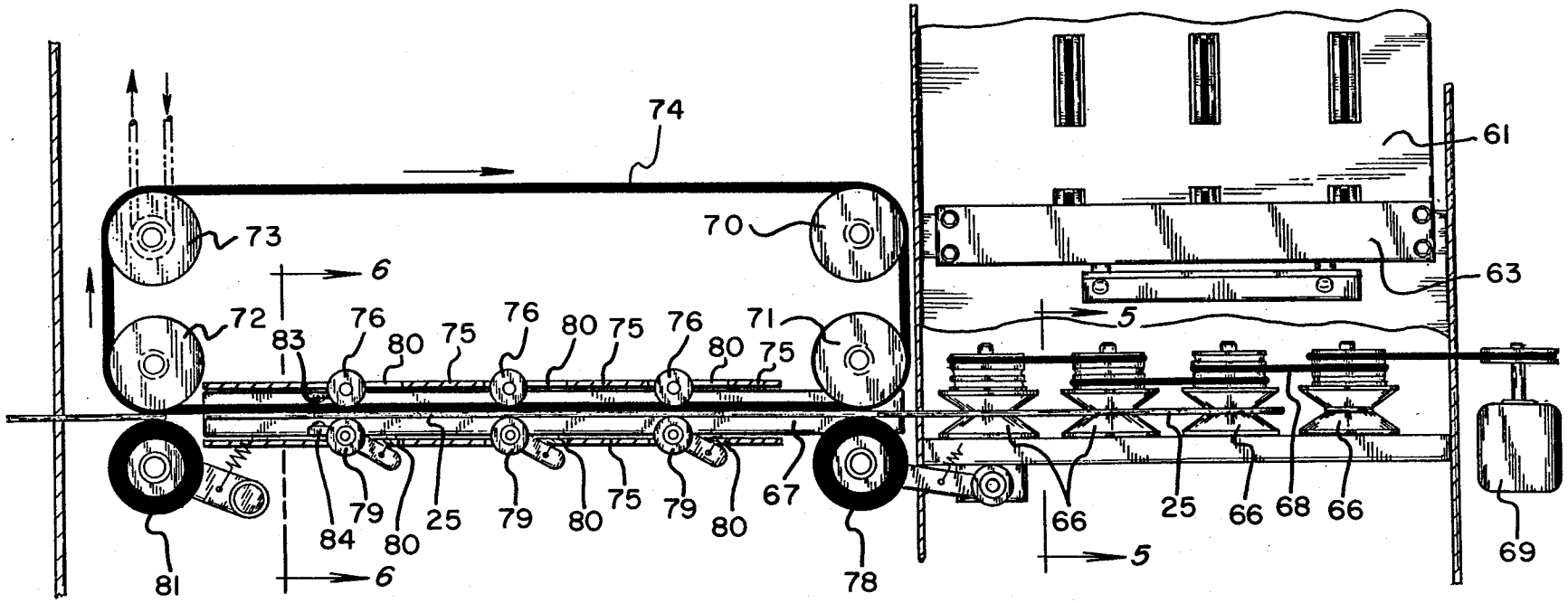
FIG. 4, is a top view of the envelope transport system of the envelope opening machine of the present invention.
Figure 5:
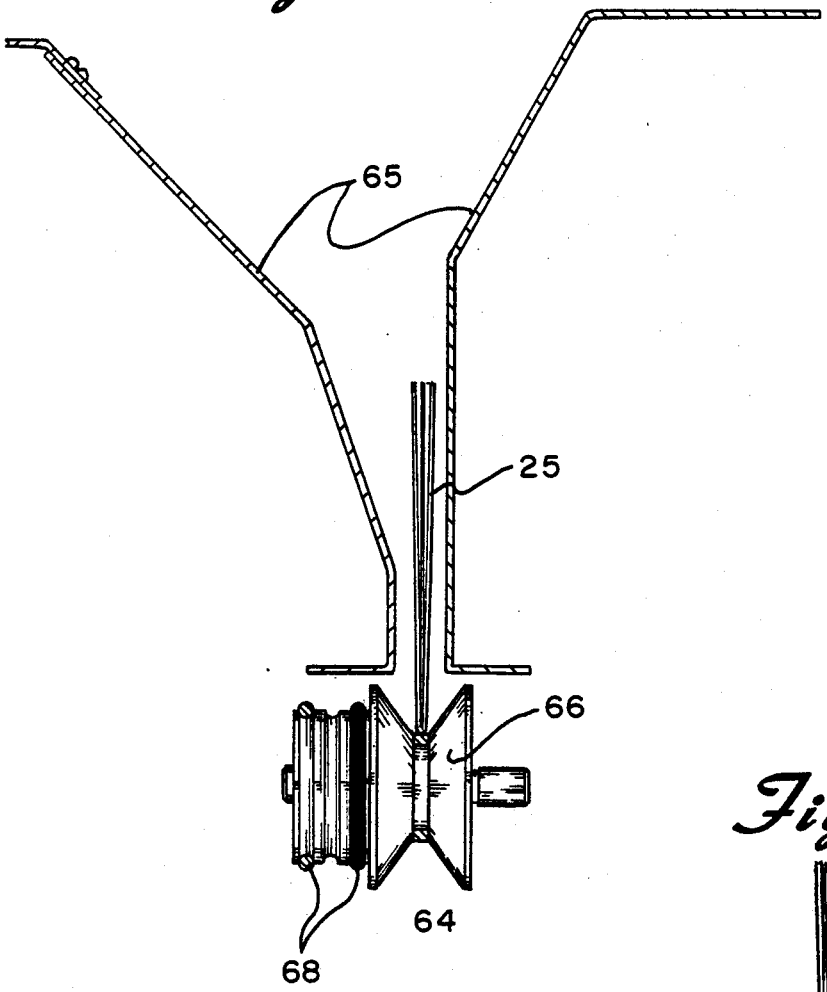
FIG. 5 is an end view of the envelope drop rollers utilized to transport the envelope to the envelope opening apparatus taken along the lines 5—5 of FIG. 4.
Figure 6:
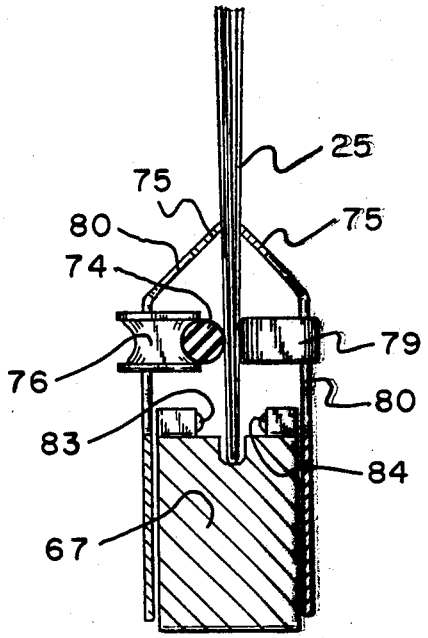
FIG. 6 is an end view partially in section of the envelope transport as utilized within the envelope opening apparatus taken along the lines 6—6 of FIG. 4.
Figure 9:
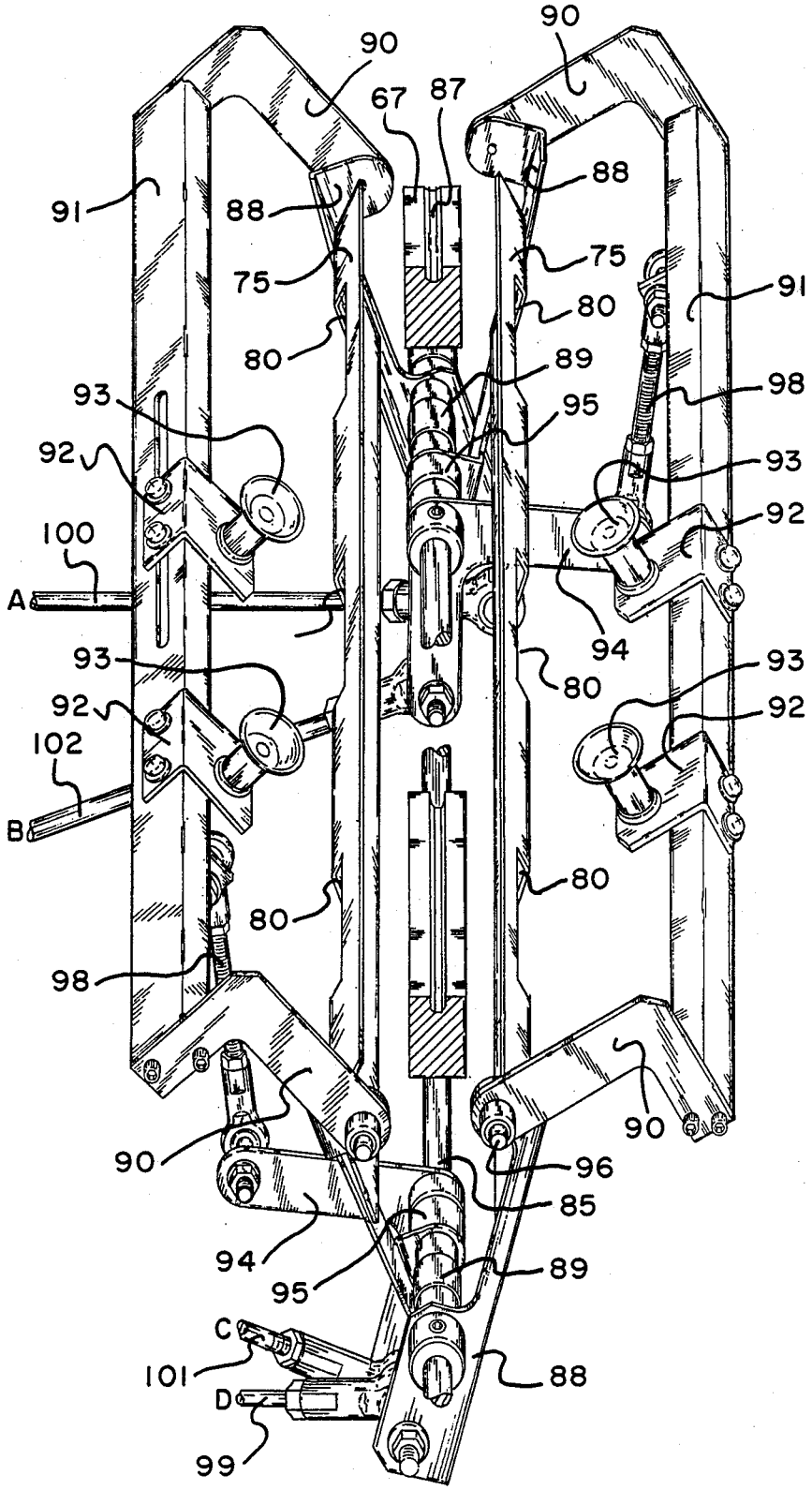
FIG. 9 is a top oblique view of the envelope opening mechanism of the present invention.

Referring now to FIGS. 4, 5 and 6, the envelope transport system is schematically shown. The envelope transport system works in conjunction with the envelope opening assembly likewise disclosed schematically in FIG. 8. The entire envelope transport system, as schematically illustrated in FIG. 4, includes a first series of drop rollers 66 which end at a folder track bar 67, whose function will be described hereinafter. The drop rollers are positioned in the bottom of the drop chute 65 as illustrated in FIGS. 2 and 3 of the drawings. The track bar 67 and its associated assemblies comprising the remainder of the envelope transport system are positioned generally within the envelope opening mechanism as schematically illustrated in FIG. 8 and as shown in FIG. 9. FIG. 9 only illustrates the folder track bar 67 with the remainder of the transport system being omitted for the purposes of clarity of illustration of the operating mechanism of the opening assembly itself. The entire combined assembly of the envelope transport system associated with the folder track bar 67 and folder opening assembly, as illustrated schematically in FIG. 8 and as pictorially illustrated in FIG. 9, are positioned generally beneath the area of the follower block 21 and beneath the feed tray 12 as illustrated in FIG. 2. The exit or left hand end of the folder track bar 67 interconnects with a track trough 16 and its associated envelope track 23 again as shown in FIGS. 2 and 3 of the drawings and as to be described in greater detail in reference to FIG. 15 hereinafter.

The operation of the transport system of the envelope opener of the present invention will now be described in reference to FIGS. 4, 5 and 6. It is to be kept in mind that, as previously stated, the left hand portion of the transport system, as shown in FIG. 4, is operating in conjunction with and is interposed within or integrated within the opening mechanism as shown in FIGS. 8 and 9 of the drawings. This relationship of the envelope transport system as it is associated with the envelope opening mechanism shown in FIG. 9 will become apparent from the description of that portion of the transport system to be undertaken hereinafter.

Referring again to FIGS. 4–6 of the drawings and particularly to the right hand portion thereof, the transport system includes four drop rollers 66. The drop rollers are appropriately journaled beneath the V-shaped drop chute 65. Each drop roller 66 includes two V-grooves therein and the four rollers are interconnected by belts 68, as shown in FIG. 4, with the first such roller being interconnected to a drive motor 69. The drive motor runs continuously and thus all four drop rollers 66 are continuously running. A high friction O-ring 64 is positioned within the deep v of the drop roller 66 to provide friction for the envelope 25 when the envelope falls through the drop chute into engagement with the drop rollers. In this manner whenever an envelope arrives at the drop chute, the envelope is immediately moved forward toward the left hand portion of the transfer mechanism.

The transfer mechanism associated with the envelope opening mechanism includes four transfer belt pullies 70–73. About these pullies there is positioned in tension a transfer belt 74 of the nature of a resilient O-ring. The transfer belt pullies 71 and 72 are positioned outside either end of the opening mechanism shown in FIG. 9, i.e. beyond either end of opposed folder blades 75. The folder transfer belt 74 is designed to run generally in alignment with and above the folder track bar 67 as generally illustrated in FIG. 6 and to likewise run through the concavity formed by the closure of the two folder blades 75 likewise as illustrated in FIG. 6.

Three stationary guide wheels 76 are appropriately journaled within the loop formed by the folder belt 74 and generally above the folder guide bar 67 as shown in FIG. 6. A groove within the guide wheels 76 provides a raceway for the folder transfer belt 74 and provides the driving interface between the transfer belt 74 and an envelope 25 positioned within the folder track bar 67 again as illustrated in FIG. 6.

Appropriate pressure is maintained upon the opposite side of the envelope from the folder transfer belt by means of a series of spring loaded pressure wheels. At the entrance end of the folder track bar 67, there is an entrance pressure wheel 78 that is positioned in opposing alignment with the idler pulley 71. Following thereafter and in alignment with the guide wheels 76 are three small pressure wheels 79. The stationary guide wheels 76 and small pressure wheels 79 are journaled in alignment with apertures 80 in the folder blades 75. As to be described hereinafter, as the folder blades 75 actuate inwardly and outwardly, the apertures 80 provide clearance between the folder blades and the stationary guide wheels 76 and small pressure wheels 79. Finally, at the exit end of the folder track bar 67 and in alignment with idler pulley 72, there is a spring loaded exit pressure wheel 81. The combination of the idler wheels and stationary wheels working in conjunction with the pressure wheels provides adequate pressure between the envelope panel and the folder transfer belt to move the envelope through the transfer mechanism when the folder transfer belt 74 is in motion. The transfer belt 74 is driven by an appropriate belt and pulley arrangement to an appropriate motor through drive pulley 73.

A photocell light 83 and associated photocell 84 are positioned just in advance of idler pulley 72. The photocell 84 is interconnected through an appropriate electronic circuit arrangement working in conjunction with the drive motor (not shown) which operates the folder transfer belt to detect the presence of an envelope as it moves along in the folder track bar and stops operation of the drive motor. The drive motor may be any of an appropriate type utilizing a quick reacting clutch and brake mechanism to quickly and accurately stop the transfer belt. As illustrated in FIG. 8, the length of the opening mechanism is designed in respect to the positioning of the photocell 84 such that the opening mechanism can accept small envelopes or large envelopes indiscriminately and their leading edge will always be positioned at the same leading point within the opening mechanism.

The electronic control circuitry for the envelope opening mechanism is such that, upon startup, the drive motor operating the folder transfer belt 74 will be actuated in the event that there is no envelope present within the opening mechanism and as sensed by the photocell 84. At this point, the feed tray mechanism will operate the conveyor chains to move the supply of envelopes forward until a photocell there senses their presence at the feed station. Each gate around the envelope slicing stations includes a photocell as well as a photocell in the drop chute area at the entrance end of the folder track bar.

The wheels associated with each wheelplate are continuously running as well as the conveyor belts and their associated slicing wheels at each station. A gate assembly operates in a manner to restrain an envelope at a particular gate from moving forward into the slicing area until the gate is actuated at which time the gate is raised permitting the envelope to move underneath the pressure wheels associated with each transfer mechanism and through the slicer assembly whereupon the envelope then reaches the next set of continuously moving wheels and is transferred to the next gate assembly.

The control circuitry of the envelope opening machine is designed for a logic such that the absence of an envelope in the drop chute area or any gate will actuate the lifting of the immediately preceding gate to permit feeding of an envelope to the drop chute area or through the preceding cutting mechanism or, in the case of the first gate, feeding from the supply hopper. In this way, the system fills up entirely and there will always be an envelope positioned at every gate awaiting for its sequential transfer through the system ultimately to the opening mechanism.

At the opening mechanism, an envelope which has dropped into the drop chute will immediately be brought up to the entrance end of the folder track bar. At this point if the folder transfer belt is not operating, the envelope will simply come up against the folder transfer belt and remain there during the cycle of operation of the opening mechanism within which there will already be an envelope sensed which will have caused the transfer belt to have stopped. Following the opening cycle of the envelope, as to be described hereinafter, the folder transfer belt control circuitry is actuated thus moving the folder transfer belt and exiting the opened envelope out the exit end of the folder transfer bar onto the envelope track as previously described. As the transfer belt begins its movement, the next following envelope already present at the entrance end of the transfer track bar will thus move into the transfer assembly until the photocell is reached at which point the folder transfer belt will be stopped. Thereafter, the logic circuitry as controlled by the photocells at the entrance end of the folder track bar and the respective gates will cycle the gates to move around the next envelope through the system.

Figure 10:
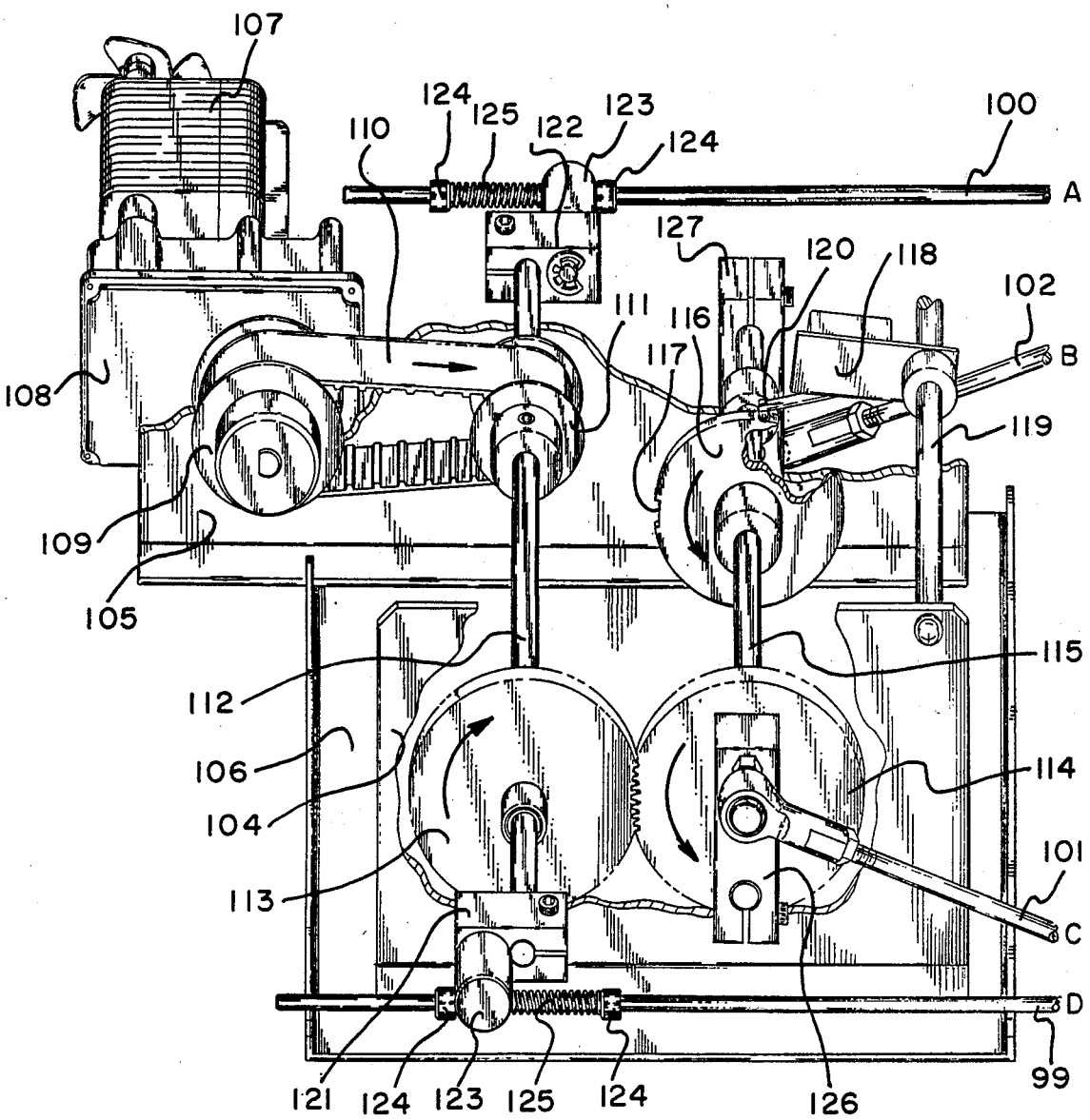
FIG. 10 is a top oblique view of the drive mechanism which operates the envelope opening mechanism of the present invention, illustrated in FIG. 9.
Figure 11:
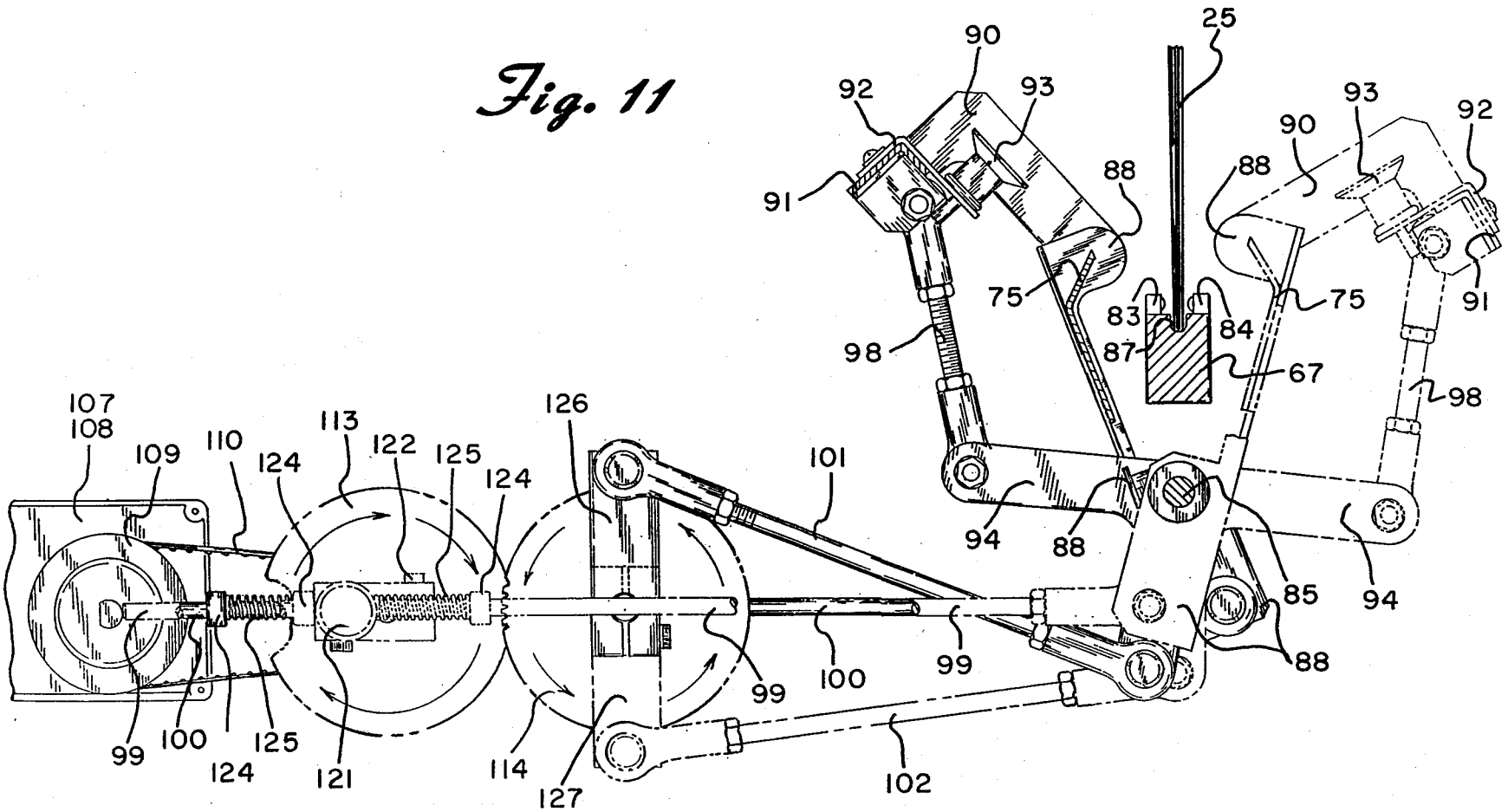
FIG. 11 is an end view partially in section through the envelope opening apparatus of the present invention showing the apparatus at rest position prior to commencement of an opening cycle.

The entire envelope opening apparatus and its drive assembly are shown in FIGS. 9 and 10 of the drawings but without the envelope transport system as earlier indicated. If FIG. 10 is placed to the left of FIG. 9 and the rods A, B, C and D interconnected, the entire assembly and its operating drive mechanism in their relative relationship to one another may be seen. FIGS. 9 and 10 show the envelope opening apparatus and its drive mechanism in an oblique perspective and in its rest position, i.e. that ready to receive an envelope to be opened. FIG. 11 is a side sectional view of the envelope opening mechanism and drive assembly and should also be referred to in conjunction with FIGS. 9 and 10 for the description of the basic components of the system which follows.

Referring to FIG. 9, the opening mechanism includes a stationary folder shaft 85. Either end of the stationary folder shaft is secured into vertical uprights which provide the basic support for the entire assembly. Likewise secured into the vertical uprights (not shown) and spaced slightly above the stationary folder shaft is a stationary folder track bar 67. The folder track bar includes a deep recess 87 therein which provides a track within which the unopened edge of the envelope being opened passes in its travel through the system.

The opening mechanism is symmetrical and the left side portions thereof may be reversed or rotated and used on the right side. The only distinction is in that the system is in opposite to itself, i.e. the various parts moving in directions toward and away from each other, the various actuating mechanisms for the major components thereof will be operating in opposite directions for the left side versus the right side. This will become more apparent from the description of the opening mechanism which follows.

Journaled upon the stationary folder shaft 85 for each complementary part of the mechanism is a pair of folder blade pivot arms 88. Secured to the upper portion of the corresponding pairs of folder blade pivot arms 88 is a folder blade 75. The respective pairs of folder blade pivot arms and associated folder blade, as previously stated, are of identical construction and are held in slight offset alignment to one another in the direction of the stationary folder shaft 85 by means of appropriate spacers 89.

At the upper end of each pair of folder blade pivot arms 88 are journaled for pivoting action a like pair of cup bar pivot arms 90. These L-shaped cup bar pivot arms 90 provide the support for a cup bar 91. The cup bar 91 carries laterally adjustable cup clips 92 to which there are secured pneumatic suction cups 93. The suction cups 93 are connected to an appropriate vacuum source through vacuum lines neither of which is shown.

The stationary folder shaft 85 also provides the journal for an L-shaped cup bar rocker arm 94 for each pair of cup bar pivot arms 90 and associated cup bar 91. Each cup bar rocker arm 94 for its associated assembly of cup bar pivot arms and cup bar are positioned one at each end of the stationary folder shaft and are appropriately positioned with respect to the remaining assembly by means of a spacer 95.

The upper end of the cup bar rocker arm 94 is pivotally interconnected to the lower end of a cup bar connecting link 98. The upper end of the cup bar connecting link 98 is pivotally interconnected to the cup bar 91.

One of the two folder blade pivot arms 88 for each folder blade 75 extends below the stationary folder shaft 85 and provides a pivotal interconnection with a folder blade crank rod 99 associated with the folder blade pivot arm 88 for the right hand folder blade 75. In a like manner but positioned at the opposite end of the stationary folder shaft, the folder blade pivot arm 88 extends downwardly below the stationary folder shaft 85 and provides a pivotal interconnection with a second folder blade crank rod 100. The folder blade crank rods 99 and 100 operate in opposite directions during cycling of the opening mechanism. Thus, it will be appreciated that, as the crank rod 99 moves to the right, the folder blade pivot arm 88 will move the folder blade 75 toward the folder track bar and the envelope positioned therein. In a like manner, retraction or movement of the folder blade crank rod 100 toward the left will likewise bring the left hand folder blade to the right toward the envelope and in converging relationship with its opposing folder blade 75. Reverse motion of the folder blade crank rods 99 and 100, of course, opens the folder blades away from one another.

The lower end of each cup bar rocker arm 94 extends below the stationary folder shaft. Interconnected to the lower portion of the cup bar rocker shaft 94 in a pivotable manner is a cup bar crank rod 101 associated with the left hand cup bar 91 and a second cup bar crank rod 102 associated with the cup bar rocker arm 94 for the right hand cup bar 91. Movement of the cup bar crank rod 101 toward the left will operate through the cup bar rocker arm 94 and cup bar connecting link 98 to pivot the left hand cup bar 91 inwardly toward the envelope. In a like manner, movement of the cup bar crank rod 102 toward the right will pivot the right hand cup bar 91 inwardly toward the envelope. Accordingly, there is a dual action occurring as the folder blade pivot arms 88 pivot inwardly toward one another they carry with them the pivot points for the cup bar pivot arms 90 while, at the same time, the cup bar pivot arms 90 are themselves being pivoted upon the folder blade pivot arms 88 by the action of the cup bar rocker arms 94 and cup bar connecting links 98.

The sequential control of the pair of folder blade crank rods 99 and 100 and the cup bar crank rods 101 and 102 and thus their associated folder blades 75 and cup bars 91 is controlled through a drive mechanism as shown in FIG. 10. The drive mechanism includes a pair of shaft supporting walls 104 and 105 and appropriate floor member 106. A drive motor 107 with an appropriate brake and clutch mechanism 108 is secured to the support wall 105 and drives through a drive pulley 109 a drive belt 110. The drive belt 110 operating through a driven pulley 111 provides the power to a folder blade crank shaft 112.

The folder blade crank shaft 112 carries thereon a folder blade crank shaft gear 113. The folder blade crank shaft gear 113 mates with and drives a cup bar shaft gear 114 of equal number of teeth. The cup bar shaft 115 in turn has disposed thereon and rotating therewith a microswitch cam shaft 116. A cam shaft detent 117 is positioned on the outer circumference of the microswitch cam 116. A microswitch 118 is supported upon a support rod 119 above the microswitch cam 116 and its cam follower 120 rides along the outer circumference of the microswitch cam 116 and is actuated upon sensing the detent 117.

The folder blade crank shaft 112 has positioned on either end thereof oppositely directed folder blade crank arms 121 and 122. The crank arm 121 is pivotally interconnected through a pivot pin 123 to folder blade crank rod 99 whereas the folder blade crank arm 122 is connected through a like pivot rod 123 to folder blade crank rod 100. Each folder blade crank arm 121 and 122 and their associated pivot pins 123 are slid and bolted upon their respective folder blade crank rods between adjustable collars 124 upon which are positioned dwell springs 125 interposed between the pivot pins 123 and one of the collars 124. The operation of the dwell springs will be described hereinafter.

The cup bar shaft 115 has upon its opposite ends oppositely directed cup bar crank arms 126 and 127. Cup bar crank arm 126 is pivotally interconnected to cup bar crank arm 101. In a like manner, cup bar crank arm 127 is pivotally interconnected to cup bar crank rod 102.

The envelope opening mechanism and its drive assembly, as shown in FIGS. 9, 10 and 11, are at the address or position ready to receive an envelope to be opened. In the sequence of events, the envelope transfer assembly is operating and an envelope is brought into the opening assembly until the photocell is engaged whereupon the transfer mechanism is stopped. At that moment, drive motor 107, which is continuously operated, is engaged through clutch 108 to drive the drive belt 110 in the direction of the arrow thereupon with consequent driving of the folder blade crank shaft 112 and cup bar shaft 115 as well as their associated crank arms all of which, in turn, move their associated crank rods. At this point, folder blade crank rod 100 begins to move to the left as the folder blade crank arm 122, through its associated pivot pin 123, begins to engage dwell spring 125. In a like manner, folder blade crank rod 99 begins to move to the right. As this occurs, the folder blades 75 begin converging together in the opener assembly.

Simultaneously, cup bar crank rod 102, through the associated action of its cup bar crank arm 127, begins to move to the right while cup bar crank rod 101 begins to move to the left. As this action is occurring, the cup bar rocker arms 94 will begin to pivot through the action of cup bar connecting links 98 the cup bars 91 toward one another and toward engagement with the envelope.

FIGS. 11, 12, 13 and 14 illustrate four distinct points in the full cycle of 360° of the four crank arms associated with the opener drive mechanism. In each of these figures, the crank arms and associated crank rods, pivot arms and rocker arms as well as folder blades and cup bars for the left hand portion of the symmetrical assembly are shown in solid lines whereas those associated with the right hand portion of the assembly are shown in phantom lines.

Figure 12:
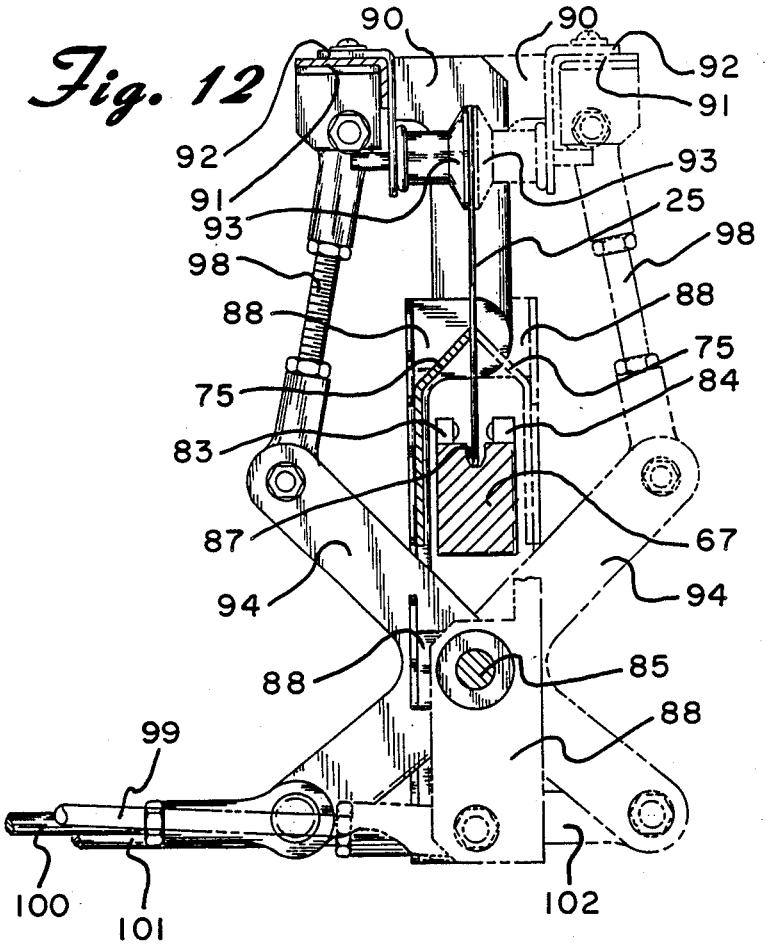
FIG. 12 is an end view partially in section through the envelope opening mechanism of the present invention at its 90° point in its cycle at which the envelope folder blades and grasping members are in engagement with the envelope panels prior to opening.

Referring now to FIG. 12, the crank arms have rotated in the direction of the arrow as shown in FIG. 10 to their 90° point. At this point, the folder blades 75 have just come into engagement with the panels of the envelope and the contents therein to provide a clamping action thereupon. Simultaneously, the folder blade pivot arms 88 carrying the folder blades 75 have moved to their vertical position wherein the pivot points 96 for the cup bar pivot arms 90 have moved into concentric alignment with one another. As best shown in FIG. 8, this pivot point 96 is slightly below the upper edge of the folder blades 75 by a distance of approximately ⅛". Further yet at the cycle point shown in FIG. 12, the cup bar rocker arms 94, working through the cup bar connecting links 98, have brought the suction cups 93 into engagement with the upper portion of the envelope 25. At this point or slightly before, the control circuitry for the opening machine introduces vacuum to the suction cups.

At the 90° crank arm position as shown in FIG. 12, the folder blade crank arms 122 and 123 will have assumed a 90° position. At this point, the pivot pins 123 will have moved the folder blade crank rods 99 and 100 against the compression of the dwell springs 125 to the point of closing of the folder blades before any appreciable compression of the dwell springs.

The drive mechanism for the opener shown in FIG. 10 operates on a one continuous complete cycle of 360° at a continuous rotational velocity. Accordingly, the action of the mechanism going from the rest position in FIG. 11 through the positions in FIGS. 12 and 13 and finally arriving back to an opened and rest position shown in FIG. 14 is one continuous action.

As the crank arms continue to rotate from their 90° position shown in FIG. 12, the folder blades continue to maintain their clamping action upon the envelope panels. However, as rotation continues beginning at the 90° point, the opposite actions of cup bar crank rods 101 and 102 will begin to operate through their respective cup bar rocker arms 94 to draw away the cup bars 91 and their associated suction cups 93. As this occurs, the envelope panels gripped by the suction cups will likewise be drawn away with the cup bars 91. However, at this time, the continued rotation of the folder bar crank arms 121 and 122 have no effect in that the pivot pins 123 will now begin to compress the dwell springs which does not cause any movement of the folder blades except that, as the increased compression occurs to a maximum point of the 180° point of revolution of the crank arms, pressure on the folder blades will increase. As these cranks begin to move toward their 270° point, the folder blades 75 will continue to be maintained into engagement with the envelope all the way until the 270° point at which compression of the dwell springs will have been substantially dissipated. Thus, the clamping action of the folder blades 75 upon the envelope is constant from a position beginning at approximately 90° of position of the crank arms through and until at least the 270° point.

Figure 13:
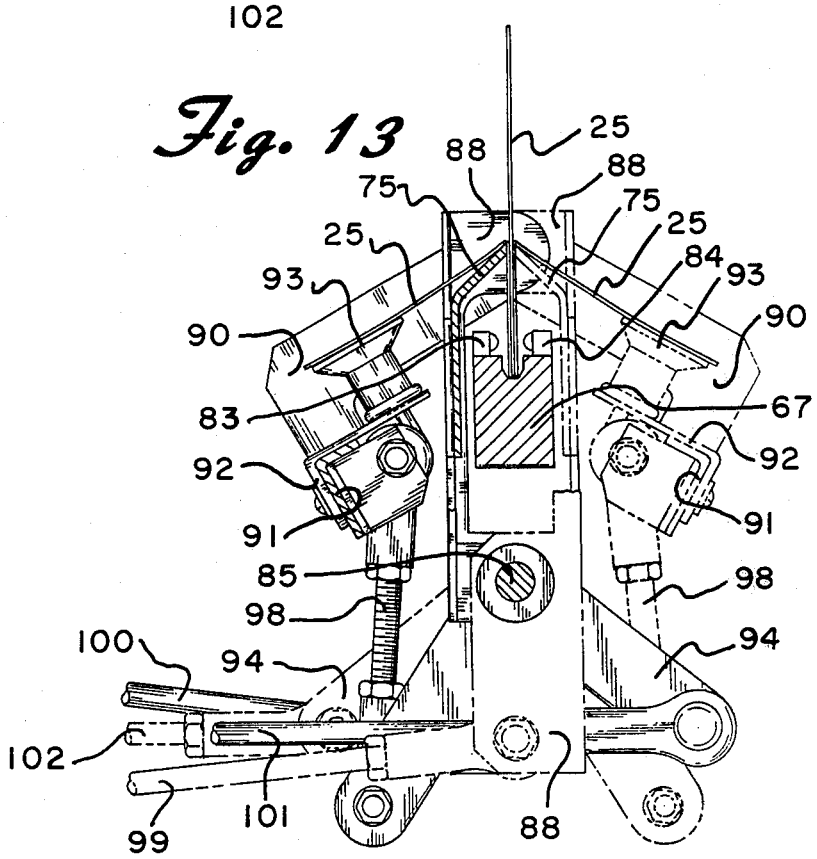
FIG. 13 is an end view partially in section through the envelope opening apparatus of the present invention at 270° in its cycle of operation illustrating the envelope panels being pulled into taut relationship with the envelope folder blades providing the envelope crease.
Figure 14:
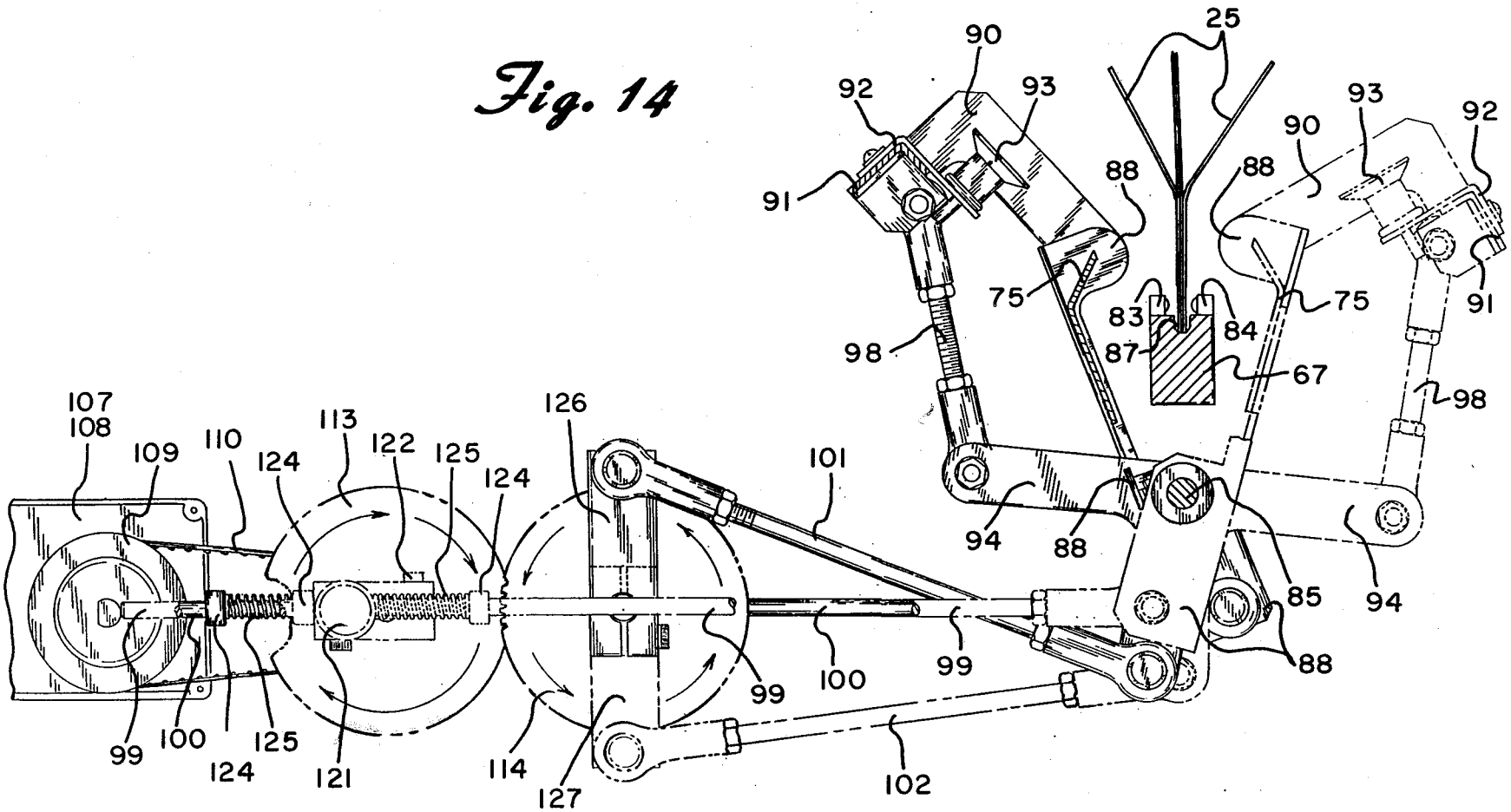
FIG. 14 is an end view partially in section through the envelope opening apparatus of the present invention illustrating the envelope apparatus having returned to its 360° or 0° rest position and illustrating the envelope with deflected and creased side panels following the envelope opening operation.

Referring now to FIG. 13, there is shown in the interrelationship of the various components of the envelope opener at the 270° cranked position. Again, the folder blades 75 are still in engagement with the panels of the envelope. At this 270° point, the cup bar 91 and its associated suction cups 93 have reached their maximum angle of separation. This totally included angle is approximately 240°. At this point, the suction cups have exerted a downward force upon the envelope panels creating a creasing action of the panels at the juncture of the upper edges of the folder blades 75. During this action due to the large included angle upon which the envelope panels are separated, any tendency of the contents within the envelope to stick to the panels is measurable inasmuch as the envelope contents simply cannot withstand this full downward angle and if they were initially adhering thereto, they will break loose and spring back up into general vertical alignment.

A significant aspect and feature of the opener of the present invention is the positioning of the pivot point 96 for the cup bar pivot arms 90 in respect to the upper edge of the folder blades 75. As previously indicated, these pivot points 96 associated with each folder bar pivot arm 88 and cup bar pivot arm 90, when in the position from 90° to 270°, are concentric with one another but spaced below the upper edge or data plane of the folder blades 75 by approximately ⅛". The effect of this is that, as the cup bar pivot arms 90 rotate from the 90° cranked position as shown in FIG. 12 to the 270° position as shown in FIG. 13, the pivotal arc of the cup bar pivot arms is not around the upper edge of the folder blades but below the same and thus is a diverging arc which pulls the panels away from the point at which they are clamped between the folder blades 75. This diverging arc creates tension in the panels thus creating a greater creasing effect of the envelope panels at the clamping point of the folder blades 75.

As the respective crank arms now begin to move from the 270° point back toward the 360° or zero rest point, the compression upon the dwell springs 125 reaches zero and the pivot pins 123 then engage the collars 124 and the folder blades begin to retract away from the envelope panels. Simultaneously, the microswitch cam follower 120 drops into the microswitch cam detent 117 signaling the reaching of the 270° point. At this point, the vacuum to the suction cups is released and the suction cups vented to atmospheric pressure thus releasing their grasp upon the envelope panels. Additionally, a timing function of approximately 200 milliseconds is initiated. Simultaneously, the crank arms associated with the cup bar crank rods also begin to operate through the cup bar rocker arms 94 and associated cup bar connecting links 98 to return the cup bars 91 to their generally upwardly disposed position as shown in FIG. 11. After the 200 millisecond timeout has occurred, the clutch on the drive motor associated with the drive system is disengaged and a brake is actuated. At this point, the entire opening mechanism has returned to the position shown in FIG. 14 which is identically the position which the mechanism assumed at the initial beginning point of the opening cycle as shown in FIG. 11 with the exception that the envelope 25, as illustrated in FIG. 14, has now had its panels creased with a permanent deforming crease. At this point, the contents of the envelope are standing essentially vertically and the opposing panels are maintained permanently in an opened position permitting easy access of the contents.

Upon timing out of the 200 millisecond timing function and return of the opening mechanism to that position shown in FIG. 14, the envelope transport system, and particularly the motor operating the folder transfer belt, is energized. As this occurs, the envelope which is grasped within the transport system is moved along the folder track bar out of the opening mechanism.

Figure 15:
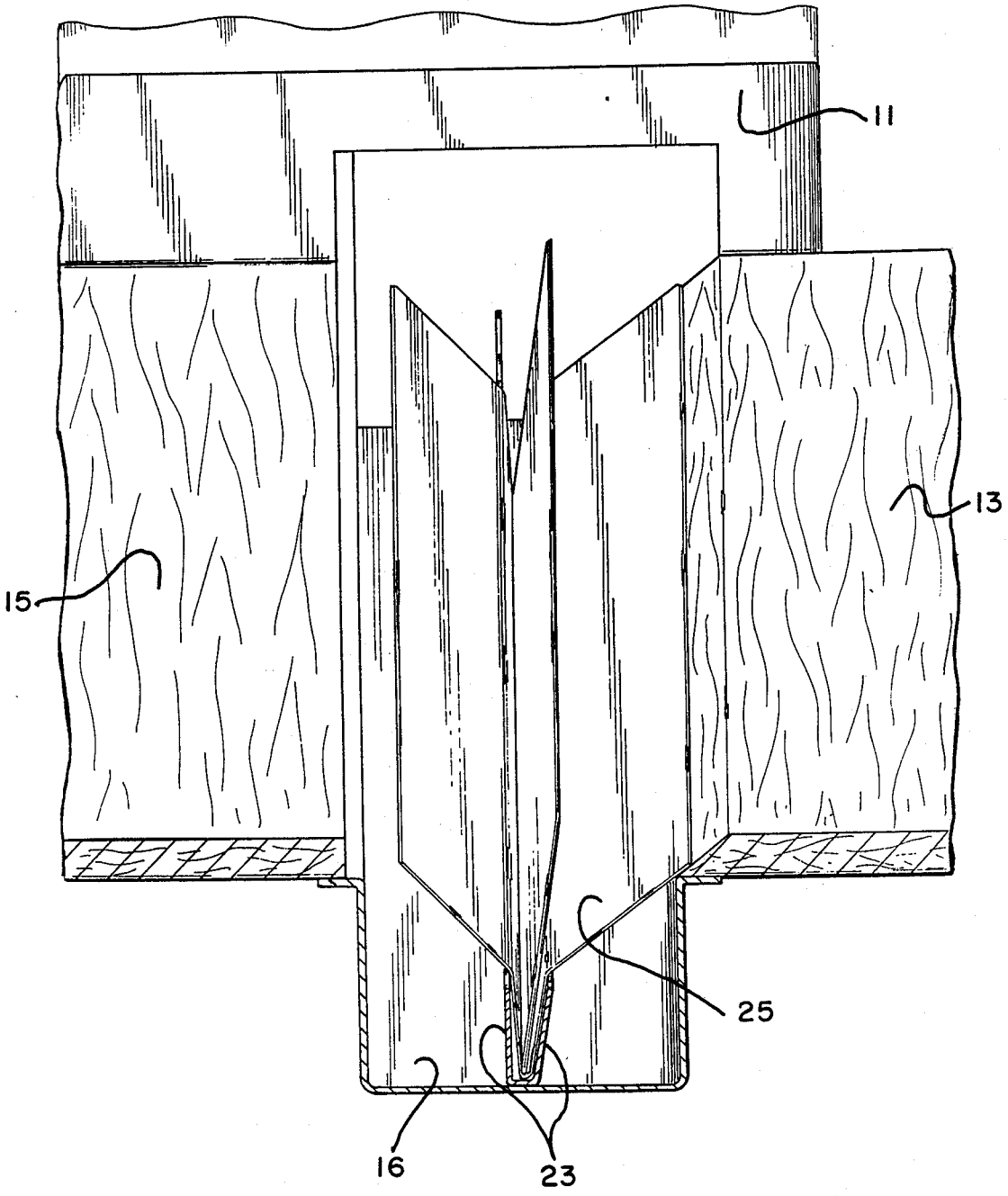
FIG. 15 is an oblique view of the envelope track of the envelope opening apparatus of the present invention into which envelopes pass following their opening operation and illustrating an opened envelope and its contents exposed therein.

Referring now to FIG. 15, there is illustrated a cross section of the track trough 16 and envelope track 23 which are positioned below and in between the front work surface 13 and back shelf 15 of the mail opening machine. The track trough 16 and associated envelope track 23 extend throughout the length of the front work surface with its right hand portion engaging the exit end of the folder track bar of the envelope opening system. The left hand end of the track trough and envelope track extend to just short of the left hand end of the front work surface. At that point, there is an opening downwardly through the front work surface which is in communication with the empty envelope receptacle.

As envelopes sequentially come into the opening mechanism, become opened and are discharged therefrom, each successive envelope will be pushed against its preceding envelope. As this sequence continues to occur, the envelopes will move along the envelope track 23 in end to end relationship with their envelope edges creased opened and the contents thereof readily exposed for ease of extraction.

As a further advantage to viewing of the exposed contents of the envelope, the envelope track 23 is of a general V-shaped configuration. However, the right hand side of the V, as shown in FIG. 15, is inclined 10° to the right from vertical. This permits the envelopes to be canted toward the front work surface to further enhance the view of the contents of the envelope.

By way of example but not limitation, the distance between the bottom of the folder track bar and the upper edge of the folder blades is approximately 1 ⅜". The angular velocity of the crank rods is constant throughout a cycle and is designed to go through a complete opening cycle at approximately 0.7 seconds. As previously mentioned, the sequence of envelopes through the opening mechanisms and into the drop chute is upon a demand situation. However, the speed of the rollers and transfer belts is such that the envelopes can pass through the system at a speed far in excess of the throughput of the opening mechanism.

The throughput of the opening mechanism is controlled through the control panel by means of circuitry which can vary the velocity of the envelope transfer belt. This velocity can be varied from a speed which will permit the throughput of envelopes into the opening mechanism for detection by the photocell to coordinate with the cycle time of the opening mechanism to provide opening at a rate of 3,000 envelopes per hour down to essentially zero throughput.

From the foregoing description of the envelope opening mechanism of the present invention, it will be appreciated that the system provides for three sided openings of the envelope utilizing vacuum without the problems of contents being adhered to the walls of the envelope. Additionally, the envelope panels are permanently creased permitting the contents thereof to be easily viewed and separated and also the envelopes move in end to end relationship past the operator for 100% extraction time.

The envelope opening machine of the present invention has been described in respect to a particular embodiment thereof as set forth in the specification taken in conjunction with the drawings. However, no limitation as to the true scope of the invention is intended by the specific embodiment thereof shown in the specification and described in the drawings inasmuch as other variations and modifications thereof may now become apparent to those skilled in the art in view thereof and therefore, the scope of the invention is to be interpreted in view of the appended claims.

What is claimed is:

1. The method of facilitating the extraction of the contents of envelopes which have been opened on three sides comprising:

providing at least a partial crease in at least one envelope panel along a line generally between the opened edges of the envelope to deform the envelope panel to leave the contents of the envelope exposed for easy extraction.

2. Apparatus for facilitating the extraction of the contents of envelopes which have been opened on three edges comprising:

envelope panel creasing means providing at least a partial crease in at least one envelope panel along a line generally between the opened edges of the envelope whereby the deformed envelope panel will leave the contents of the envelope exposed for easy extraction.

3. The apparatus of claim 2 wherein the clamping means includes opposed elongate folder blades pivoted upon a first common axis and between which the envelope is disposed.

4. The apparatus of claim 3 wherein the grasping means includes opposed elongate grasping members disposed parallel to the folder blades and each pivoted upon a second axis and between which the envelope is disposed.

5. The apparatus of claim 4 wherein each grasping member is pivoted upon a companion folding blade.

6. The apparatus of claim 5 wherein the folding blades each include a sharp envelope panel engaging edge which align with one another when in engagement with the envelope panels.

7. The apparatus of claim 6 wherein the second axis of each grasping means pivoted upon its companion folding blade are in concentric alignment with one another when the envelope panel engaging edges of the folder blades are in engagement with the envelope panels.

8. The apparatus of claim 7 wherein the second axes of the grasping members when in concentric alignment are in parallel alignment with the envelope panel engaging edges but not concentric therewith in a direction to provide a diverging arcuate movement of the grasping means pivoting upon their second axes relevant to the axes of the envelope panel engaging means to cause tension upon the envelope blades across the envelope panel engaging edges to enhance creasing thereof.

9. The apparatus of claim 4 further including envelope transport means for selectively conveying the envelope to be opened into and out of position between the elongate folder blades and grasping members.

10. The apparatus of claim 9 further including envelope transport control means adapted to detect the presence of an envelope between the folder blades to discontinue operation of the envelope transport means and cycle the folder blades and grasping members between an initial release position through engagement with the envelope panels and return to release position with consequent reactuation of the transport means.

11. The apparatus of claim 10 further including an envelope receiving track positioned at the end of the envelope transport to receive opened envelopes and their included contents.

12. The apparatus of claim 11 further including second envelope transport means to deliver unopened envelopes to the envelope transport means.

13. The apparatus of claim 12 further including envelope opening means for opening envelopes on three sides and delivering the envelopes to the second envelope transport means and envelope hopper means for storing a quantity of unopened envelopes and delivering them sequentially to the envelope opening means.

14. The apparatus of claim 8 further including envelope transport means for selectively conveying the envelope to be opened into and out of position between the elongate folder blades and grasping members.

15. The apparatus of claim 14 further including envelope transport control means adapted to detect the presence of an envelope between the folder blades to discontinue operation of the envelope transport means and cycle the folder blades and grasping members between an initial release position through engagement with the envelope panels and return to release position with consequent reactuation of the transport means.

16. The apparatus of claim 15 further including an envelope receiving track positioned at the end of the envelope transport to receive opened envelopes and their included contents.

17. The apparatus of claim 16 further including second envelope transport means to deliver unopened envelopes to the envelope transport means.

18. The apparatus of claim 17 further including envelope opening means for opening envelopes on three sides and delivering the envelopes to the second envelope transport means and envelope hopper means for storing a quantity of unopened envelopes and delivering them sequentially to the envelope opening means.

19. Apparatus for facilitating the extraction of the contents of envelopes which have been opened on three edges comprising:

releasable envelope panel clamping means adapted to clamp together at least a portion of the opposed side panels of the envelope and included contents along a datum line between the opposed open edges of the envelope; and releasable envelope panel grasping means adapted to grasp the opposed envelope side panels between the datum line and the third opened edge and draw the opposed panels into engagement with the clamping means to produce an envelope panel deforming crease in the envelope panels generally along the datum line whereby the envelope panels will remain in an open position exposing the contents of the envelope upon release of the clamping means and grasping means.

20. The method of facilitating the extraction of the contents of envelopes which have been opened on three sides comprising the steps of:

clamping together at least a portion of the opposed side panels of the envelope and included contents therein along a datum line between the opposed opened edges of the envelope; and grasping the opposed envelope side panels between the datum line and the third opened edge and drawing the opposed panels into engagement with the clamping means to produce an envelope panel deforming crease in the envelope panels generally along the datum line causing the envelope panels to remain in an opened position exposing the contents of the envelope upon release of the clamping means and grasping means.

21. The method of claim 20 wherein the step of clamping at least a portion of the opposed side panels is accomplished by means of opposed elongate folder blades pivoted upon a first common axis.

22. The method of claim 21 wherein the envelope panels are grasped by opposed elongate grasping members disposed parallel to the folder blades and each pivoted upon a second axis.

* * * * *